US005270675A

United States Patent [19]

Mori et al.

[11] Patent Number: 5,270,675

[45] Date of Patent: Dec. 14, 1993

[54] HIGHLY CONDUCTIVE MAGNETIC MATERIAL

[75] Inventors: Toshihiko Mori; Hikohiro Togane; Tonizo Minezaki, all of Sagamihara, Japan

[73] Assignee: Mitsubishi Denki Kabushiki Kaisha, Tokyo, Japan

[21] Appl. No.: 688,829

[22] Filed: Apr. 22, 1991

Related U.S. Application Data

[63] Continuation-in-part of Ser. No. 578,437, Sep. 7, 1990, abandoned.

[30] Foreign Application Priority Data

Nov. 13, 1989 [JP] Japan ..... 1-294663

[51] Int. Cl.[5] ..... H01H 50/60; H01F 1/00; H01F 3/00

[52] U.S. Cl. ..... 335/128; 335/296; 335/297

[58] Field of Search ..... 335/128, 276, 296, 297, 335/298, 299; 336/233

[56] References Cited

U.S. PATENT DOCUMENTS 4,004,167 1/1977 Meckling ..... 335/302
4,818,965 4/1989 Hinrichs et al. ..... 335/128

FOREIGN PATENT DOCUMENTS 56-98440 8/1981 Japan .
63-245930 10/1988 Japan .

*Primary Examiner*—Harold Broome
*Attorney, Agent, or Firm*—Oblon, Spivak, McClelland, Maier & Neustadt

[57] ABSTRACT

A highly conductive magnetic material useful for a magnet or a magnetic core for an electromagnet, obtained by molding copper or a copper alloy having ferrite dispersed therein.

15 Claims, 1 Drawing Sheet

HIGHLY CONDUCTIVE MAGNETIC MATERIAL

This application is a Continuation-in-Part of application Ser. No. 07/578,437 filed on Sep. 7, 1990, now abandoned.

The present invention relates to a highly conductive magnetic material having excellent magnetic properties and high electric conductivity useful for a magnet or a magnetic core for an electromagnet, etc.

Magnetic materials include metallic type and nonmetallic type. Most of non-metallic type magnetic materials have no substantial electric conductivity. Metallic type magnetic materials are composed mainly of iron and nickel, and thus they are substantially inferior to copper in the electric conductivity. Among conventional magnetic materials, there was no magnetic material having high electric conductivity.

Conventional magnetic materials have not been used as highly conductive magnetic materials, since they are inferior in the electric conductivity even in the case of metallic materials.

It is an object of the present invention to solve such a problem of the conventional magnetic materials and to provide a highly conductive magnetic material having excellent magnetic properties an high electric conductivity.

Thus, the present invention provides a highly conductive magnetic material useful for a magnet or a magnetic core for an electromagnet, obtained by molding copper or a copper alloy having ferrite dispersed therein.

Now, the present invention will be described in detail with reference to the preferred embodiments.

Figure 1:
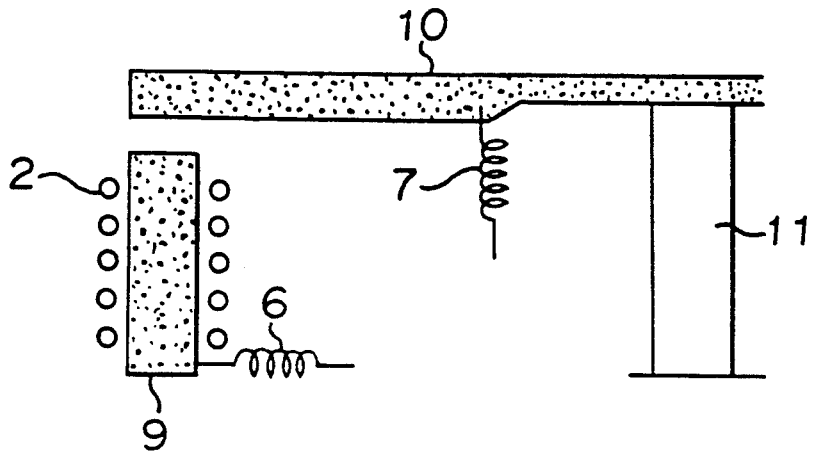
FIG. 1 is a schematic view illustrating the construction of a relay wherein the highly conductive magnetic material of the present invention is used.

According to the present invention, high electric conductivity and excellent magnetic properties are obtained by dispersing ferrite in copper or a copper alloy, followed by molding. The reason will be explained as follows.

When a certain substance is added to a conductive metal, and the added substance is solid-solubilized in the conductive metal, the crystal lattice of the conductive metal will be distorted as the solid-solubilization proceeds, whereby the electric resistance will increase. On the other hand, if the added substance is not solid-solubilized in the conductive metal at all, the distortion of the crystal lattice will be little, since the crystal lattice of the conductive metal is not continuous with the added substance, and it is considered that the conductivity will decrease only in correspondence with the volume occupied by the added substance in the conductive metal. Accordingly, electric conductivity corresponding substantially to the average by weight ratio of the conductive material and the added substance, will be obtained. The present invention is based on this principle, and ferrite having excellent magnetic properties and insoluble in copper or a copper alloy, is dispersed in copper or a copper alloy having high electric conductivity, followed by molding, whereby it is possible to obtain a highly conductive magnetic material having excellent magnetic properties and high electric conductivity.

In the present invention, the ferrite is dispersed usually in an amount of from 1 to 4 parts by weight, preferably from 1.5 to 2.34 parts by weight, per part by weight of the copper or copper alloy. The ferrite usually has an average particle size of from 10 to 300 μm, preferably from 150 to 250 μm.

The copper alloy includes, for example, a copper-Nickel alloy, a copper-Zinc alloy, a copper-Nickel-Zinc alloy, and a copper-Tin alloy.

Now, the present invention will be described in further detail with reference to Examples. However, it should be understood that the present invention is by no means restricted by such specific Examples.

To one part by weight of pure copper powder produced by a water-atomize method having a average particle size of 150 μm and the properties as identified in Table 1, 2 parts by weight of ferrite powder having an average particle size of 200 μm and the properties as identified in Table 1, were added and thoroughly mixed, and the mixture was press-molded into a rod having a diameter of 10 mm and a length of 50 mm, which was then heated to 900° C. and sintered for 2 hours in a nitrogen atmosphere.

TABLE 1

| | Permeability | Resistivity μΩ cm | Electric conductivity % IACS | Specific gravity |
|---|---|---|---|---|
| Pure copper | — | 1.724 | 100 | 8.94 |
| Ferrite Ni—Cu—Zn system) | 700 | $10^9$ (Ω cm) | — | 5.10 |

Both ends of the sintered molded rod were polished to have smooth surfaces, and a coil was wound on the rod, and the permeability, the resistivity, the electric conductivity and the specific gravity were measured, whereby the results as shown in Table 2 were obtained.

TABLE 2

| | Permeability | Resistivity μΩ cm | Electric conductivity % IACS | Specific gravity |
|---|---|---|---|---|
| Sintered molded rod | 20 | 5.5 | 31.4 | 5.97 |

From the results in Table 2, it is evident that the molded rod sintered with ferrite powder dispersed in copper, ha excellent magnetic properties and high electric conductivity Now, the magnetic material according to the present invention has both magnetic properties and electric conductivity and is accordingly applicable to a relay wherein the magnetic part and the conductive part are integrated. Its application Example will be described in comparison with a conventional relay.

Figure 2:
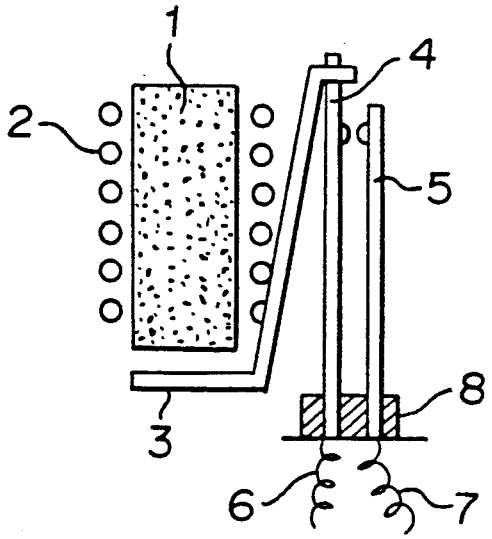
FIG. 2 is a schematic view illustrating the construction of a relay of a conventional type.

FIG. 2 is a schematic view illustrating the construction of the conventional relay. When an electric current is conducted to the coil 2, the magnetic core 1 will be magnetized and attracts an iron core 3, whereupon a movable terminal 4 with one end fixed to a supporting table 8 will move towards a fixed terminal 5 and will contact the fixed terminal 5, and conductors 6 and 7 will be electrically connected. FIG. 1 is a schematic view illustrating a relay wherein the highly conductive magnetic material of the present invention is used. When an electric current is conducted to a coil 2, the highly conductive magnetic core 9 will be magnetized and attracts a movable highly conductive magnetic spring 10 with one end fixed to a supporting pole 11, whereupon the movable highly conductive magnetic spring 10 will be in contact with the highly conductive magnetic core 9 so that conductors 6 and 7 will be electrically connected.

As described above, the construction of the relay according to the present invention is simple in the construction of the relay as compared with the construction of the relay of the conventional type.

The above Example illustrates a case wherein soft ferrite powder was employed for sintering and molding to obtain the highly conductive magnetic material. However, when hard ferrite powder is employed as the ferrite powder, it is possible to obtain a permanent magnet having high conductivity.

As described in the foregoing, the present invention provides a highly conductive magnetic material having excellent magnetic properties and high electric conductivity, since ferrite is dispersed in copper or a copper alloy, and such a magnetic material has a wide range of applications. For example, when it is used for a relay, the construction of the relay can be simplified.

What is claimed as new and desired to be secured by Letters Patent of the United States is:

1. A highly conductive electromagnet comprising:

a) a magnetic core obtained by molding copper or a copper alloy having 1–2 parts by weight of ferrite per part by weight of copper or copper alloy dispersed therein; and b) a conductive coil wound around an outer peripheral surface of said magnetic core.

2. The electromagnet of claim 1 wherein said magnetic core is a rod having a diameter 5 times the length.

3. The electromagnet of claim 1, wherein said ferrite has an average particle size of from 10–300 μm.

4. The electromagnet of claim 1, wherein said ferrite is a magnetically soft ferrite.

5. The electromagnet claim 1, wherein said ferrite is present in from 1.5–2.0 parts by weight.

6. The highly conductive electromagnet of claim 1, wherein said ferrite is insoluble in copper or copper alloy.

7. A highly conductive magnetic relay comprising:

i) a highly conductive electromagnet comprising:

a) a conductor;

b) a conductive, magnetic core obtained by molding copper or a copper alloy having 1–2 parts by weight of magnetically soft ferrite per part by weight of copper or copper alloy dispersed therein, wherein said conductor is attached to said conductive magnetic core; and c) a conductive coil wrapped around an outer peripheral surface of said conductive magnetic core; and ii) a highly conductive magnetic spring comprising:

d) a highly conductive magnetic spring obtained by molding copper or a copper alloy having 1–2 parts by weight of magnetically hard ferrite per part by weight of copper or copper alloy dispersed therein, said conductive magnetic spring being located within the induced magnetic field of said highly conductive electromagnet and is capable of being attracted to and contacted with said electromagnet when a magnetic field is induced in said electromagnet;

e) means for supporting said highly conductive magnetic spring;

f) a second conductor, attached to said highly conductive magnetic spring;

wherein when an electric current is applied to said conductive coil, said magnetic core becomes magnetized and attracts and contacts said conductive magnetic spring, thereby conductively connecting said conductors.

8. The highly conductive magnetic relay of claim 7, wherein said magnetically soft ferrite and said magnetically hard ferrite are insoluble in copper or copper alloy.

9. A highly conductive electromagnet comprising:

a) a magnetic core obtained by molding copper or a copper alloy having 2 parts by weight of ferrite per part by weight of copper or copper alloy dispersed therein; and b) a conductive coil wound around an outer peripheral surface of said magnetic core.

10. The electromagnetic of claim 9 wherein said magnetic core is a rod having a diameter 5 times the length.

11. The electromagnet of claim 9, wherein said ferrite has an average particle size of from 10–300 μm.

12. The electromagnet of claim 9, wherein said ferrite is a magnetically soft ferrite.

13. The highly conductive magnetic relay of claim 9, wherein said ferrite is insoluble in copper or a copper alloy.

14. A highly conductive magnetic relay comprising:

i) a highly conductive electromagnet comprising:

a) a conductor;

b) a conductive, magnetic core obtained by molding copper or a copper alloy having 2 parts by weight of magnetically soft ferrite per part by weight of copper or copper alloy dispersed therein, wherein said conductor is attached to said conductive magnetic core; and c) a conductive coil wrapped around an outer peripheral surface of said conductive magnetic core; and ii) a highly conductive magnetic spring comprising:

d) a highly conductive magnetic spring obtained by molding copper or a copper alloy having 1–2 parts by weight of magnetically hard ferrite per part by weight of copper or copper alloy dispersed therein, said conductive magnetic spring being located within the induced magnetic field of said highly conductive electromagnet and is capable of being attracted to and contacted with said electromagnet when a magnetic field is induced in said electromagnet;

e) means for supporting said highly conductive magnetic spring;

f) a second conductor, attached to said highly conductive magnetic spring;

wherein when an electric current is applied to said conductive coil, said magnetic core becomes magnetized and attracts and contacts said conductive magnetic spring, thereby conductively connecting said conductors.

15. The highly conductive magnetic relay of claim 14, wherein said magnetically soft ferrite and said magnetically hard ferrite are insoluble in copper or copper alloy.

* * * * *